US006386544B2

(12) United States Patent
Chang

(10) Patent No.: US 6,386,544 B2
(45) Date of Patent: May 14, 2002

(54) DARTBOARD WITH AUTO-RETURNING TARGET PLATES

(76) Inventor: Wen-Fang Chang, No. 2-1, Yi-Fu St., Yi-Hsin Li, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/760,644

(22) Filed: Jan. 17, 2001

(30) Foreign Application Priority Data

Apr. 29, 2000 (TW) ..... 089207096

(51) Int. Cl.[7] ..... F41J 5/052
(52) U.S. Cl. ..... 273/376
(58) Field of Search ..... 273/371–376, 273/403, 404, 407, 408

(56) References Cited

U.S. PATENT DOCUMENTS 4,651,998 A * 3/1987 Holt et al. ..... 116/225
4,836,556 A * 6/1989 DeVale et al. ..... 273/376
5,518,250 A * 5/1996 Lu et al. ..... 273/348.5
5,718,433 A * 2/1998 Lu et al. ..... 273/374
5,788,244 A * 8/1998 Hui et al. ..... 273/374
5,988,646 A * 11/1999 Fair ..... 273/371
6,047,968 A * 4/2000 Lu et al. ..... 273/371
6,089,571 A * 7/2000 Cho ..... 273/371
6,116,607 A * 9/2000 Cho ..... 273/371
6,215,390 B1 * 4/2001 Lin ..... 273/371

* cited by examiner

*Primary Examiner*—Mark S. Graham
(74) *Attorney, Agent, or Firm*—Rabin & Berdo, P.C.

(57) ABSTRACT

A dartboard has a plurality of auto-returning target plates fitted in a grid frame which is enclosed in an outer ring, and has a grid fixed on a front end of the grid frame, a rear board mounted on rear ends of the grid frame and the outer ring, and an electric circuit board mounted on a rear end of the rear board. Each spring has a first end thereof positioned by a corresponding guide element, and a second end thereof extended through the corresponding hole of the rear board and lightly contacted with the electric circuit board. The auto-returning target plates are able to be depressed when darts are thrown and stick on the target plate and automatically returned to an original position by resilience of the springs.

2 Claims, 5 Drawing Sheets

DARTBOARD WITH AUTO-RETURNING TARGET PLATES

BACKGROUND OF THE INVENTION

1. Field of the Invention

The present invention relates to a dartboard having a plurality of auto-returning target plates respectively fitted in a plurality of receiving spaces, which are defined in a grid frame according to the shape of score sectors of the dartboard.

2. Description of Related Art

As illustrated in FIGS. 5 and 6, a conventional dartboard has a grid frame (10) defined with a plurality of receiving spaces (11) according to different score sectors, an outer ring (30) enclosing the grid frame (10) therein, a grid (40) assembled on a front end of the grid frame (10), a rear board (50) fixed at rear ends of the grid frame (10) and the outer ring (30), and an electric circuit board (60) fixed at a rear end of the rear board (50). A plurality of target plates (80) are respectively received in the receiving spaces (11) of the grid frame (10). Each target plate (80) has a plurality of projected members (81) formed at a bottom surface thereof. The rear board (50) is defined with a plurality of holes (51) corresponding to the plurality of projected members (81) of the target plate (80), whereby the projected members of the target plates (80) respectively extend through the holes (51) of the rear board (50). When a dart is thrown and strikes one of the target plates (80), the projected members (81) of the target plate (80) are pressed against electric sensors on the electric board (60), thereby a signal is sent out and a score of the dart is calculated.

A defect of the above described conventional dartboard is that the target plates (80) hit by the darts are possibly jammed in the receiving spaces (11), and the projected members (81) may be stuck on the electric board (60), such that the sensors of the electric board (60) will be not ready for a subsequent throwing of the darts, and the calculation of the dart score will fail.

Another defect of the above-described conventional dartboard is hat the target plates (80) do not have an auto-returning movement, and this absence leads to irritation of the players.

Therefore, it is an objective of the invention to provide an improved dartboard with auto-returning target plates to mitigate and/or obviate the aforementioned problems.

SUMMARY OF THE INVENTION

The object of the invention is to provide a dartboard particularly having a plurality of auto-returning target plates which are able to be depressed when darts are thrown and stuck thereon, and to return to their initial position by resilience of elastic members provided between the target plates and a rear board of the dartboard, whereby the game of darts is especially enjoyable and convenient.

Another object of the invention is to provide a dartboard with the auto-returning target plates, wherein the auto-returning target plates hit by darts are always automatically returned by resilience of the elastic members, and the target plates never jam in the receiving space, whereby the sensitivity of sensors of the electric circuit board and the precision of calculation of the darting score are ensured.

Other objects, advantages and novel features of the invention will become more apparent from the following detailed description when taken in conjunction with the accompanying drawings.

DETAILED DESCRIPTION OF THE PREFERRED EMBODIMENT

Figure 1:
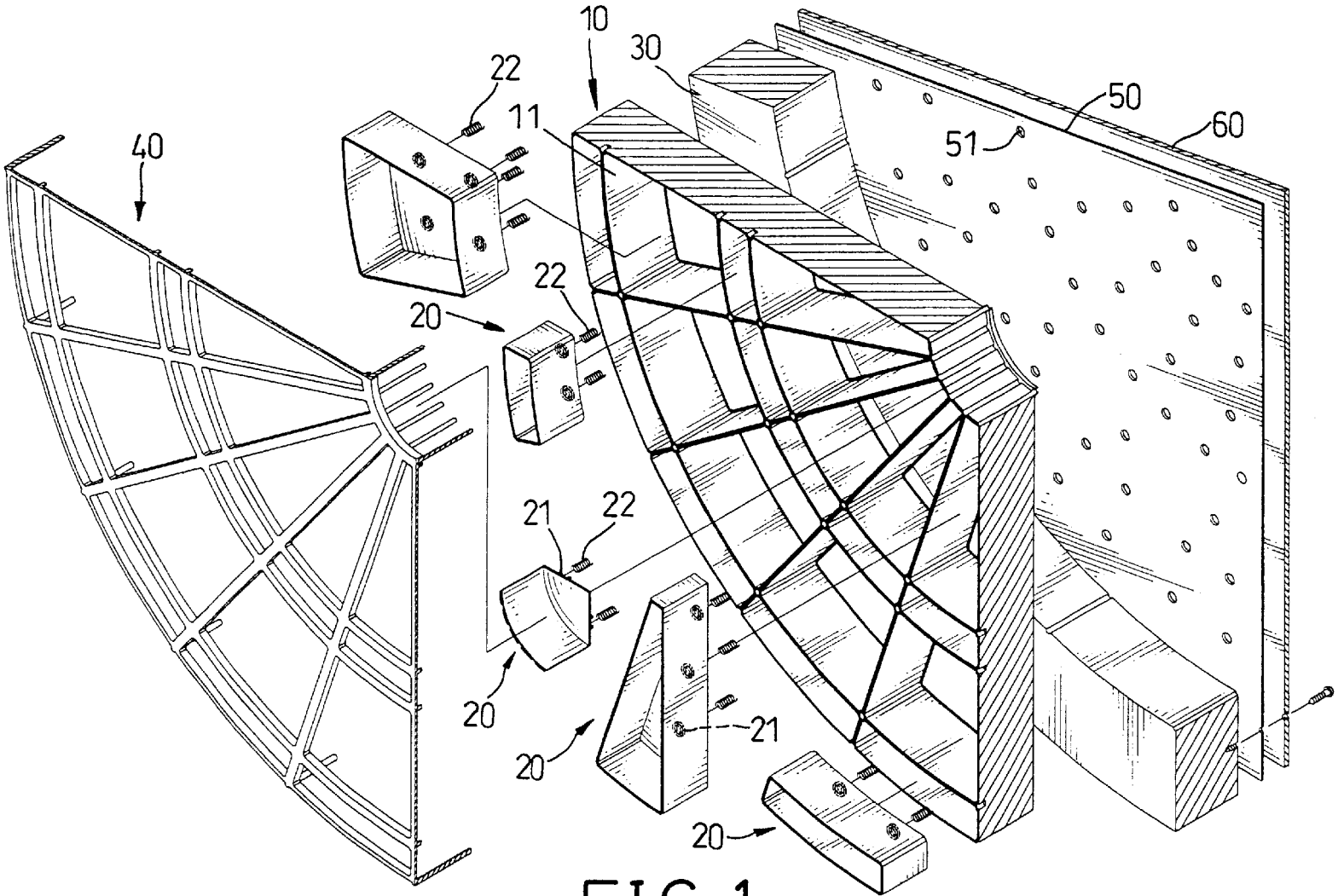
FIG. 1 is an exploded perspective view of a dartboard with auto-returning target plates in accordance with the invention.

As shown in FIG. 1, a dartboard of the invention comprises a grid frame (10), a plurality of auto-returning target plates (20) respectively fitted in receiving spaces (11) defined in the grid frame (10), an outer ring (30) enclosing the grid frame (10) therein, a grid (40) fixed on a front end of the grid frame (10), a rear board (50) mounted on rear ends of the grid frame (10) and the outer ring (30), and an electric circuit board (60) mounted on a rear end of the rear board (50).

Figure 2:
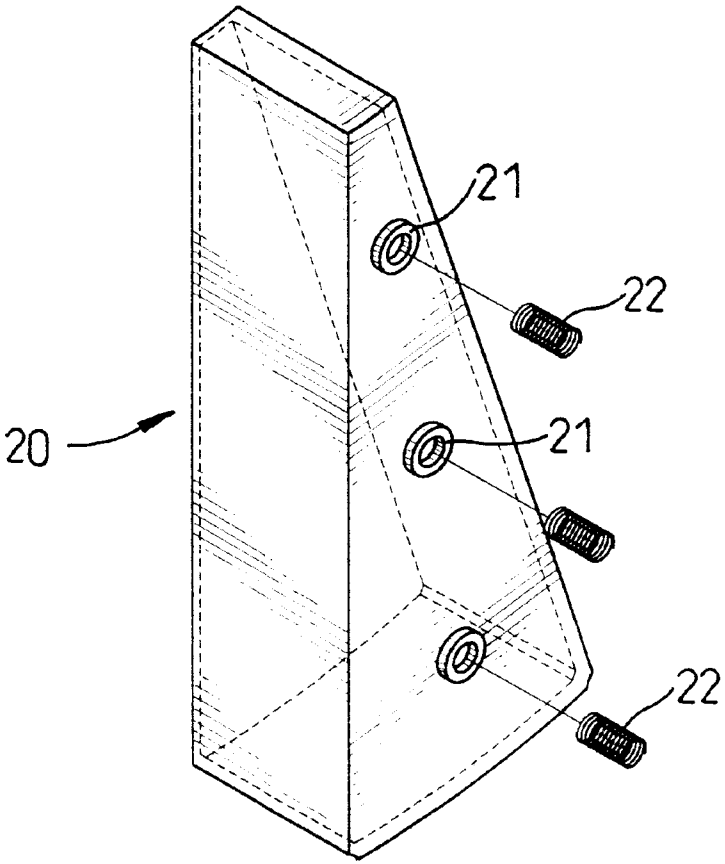
FIG. 2 is a perspective view of an auto-returning target plate of the dartboard in accordance with the invention in assembly.

As shown in FIG. 2, each auto-returning target plate (20) has a plurality of guide elements (21) formed on a bottom surface thereof. Each guide element (21) is defined with a positioning hole corresponding to one of a plurality of springs (22).

Figure 3:
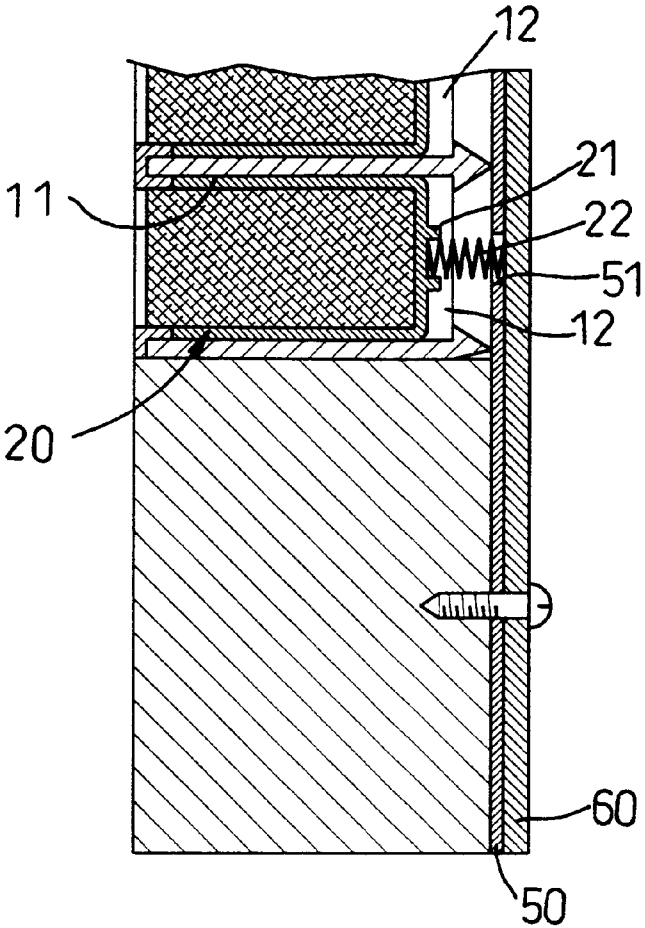
FIG. 3 is a partial cross sectional view of the dartboard of the invention, showing the auto-returning target plate in an original static status before it is hit by a dart.
Figure 4:
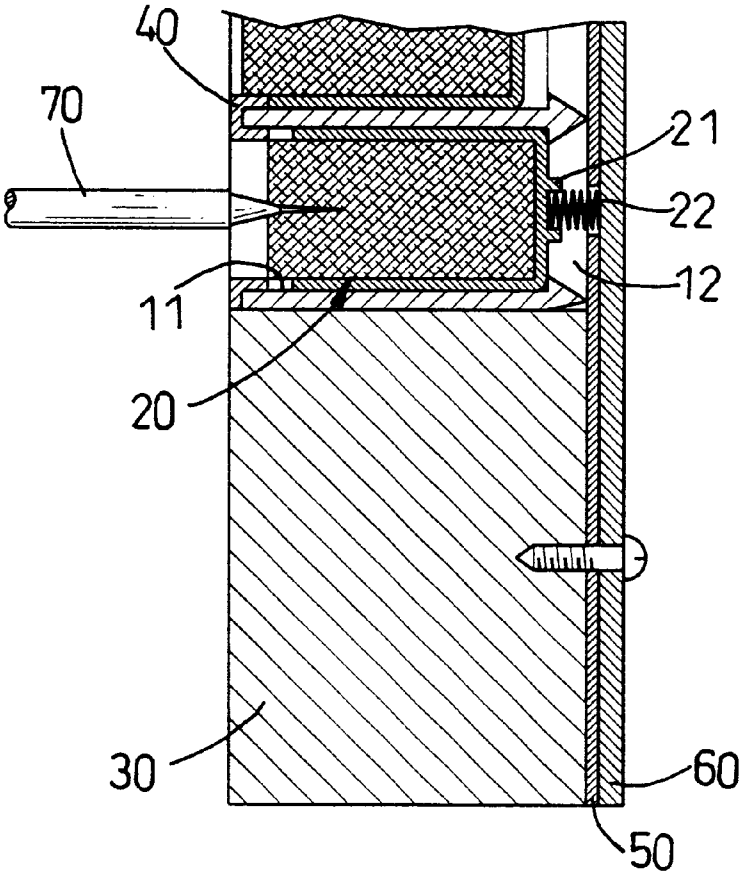
FIG. 4 is a partial cross sectional view of the dartboard of the invention, showing the auto-returning target plate moving axially when it is hit by a dart.
Figure 5:
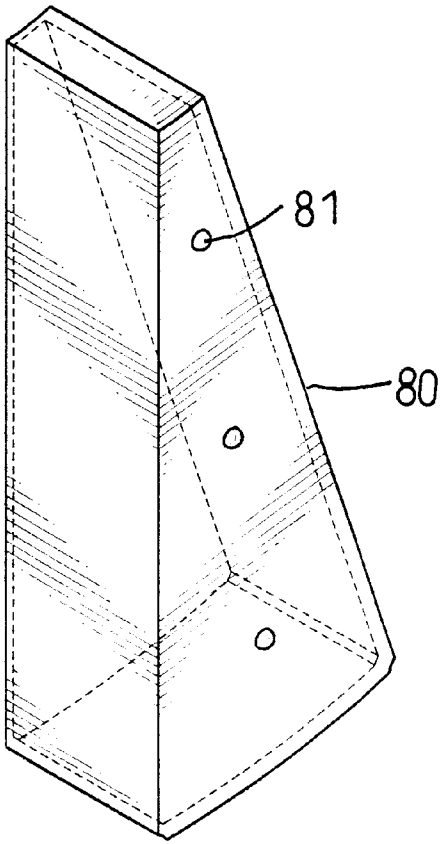
FIG.5 PRIOR ART
FIG. 5 is a perspective view of a conventional target plate of a conventional dartboard.
Figure 6:
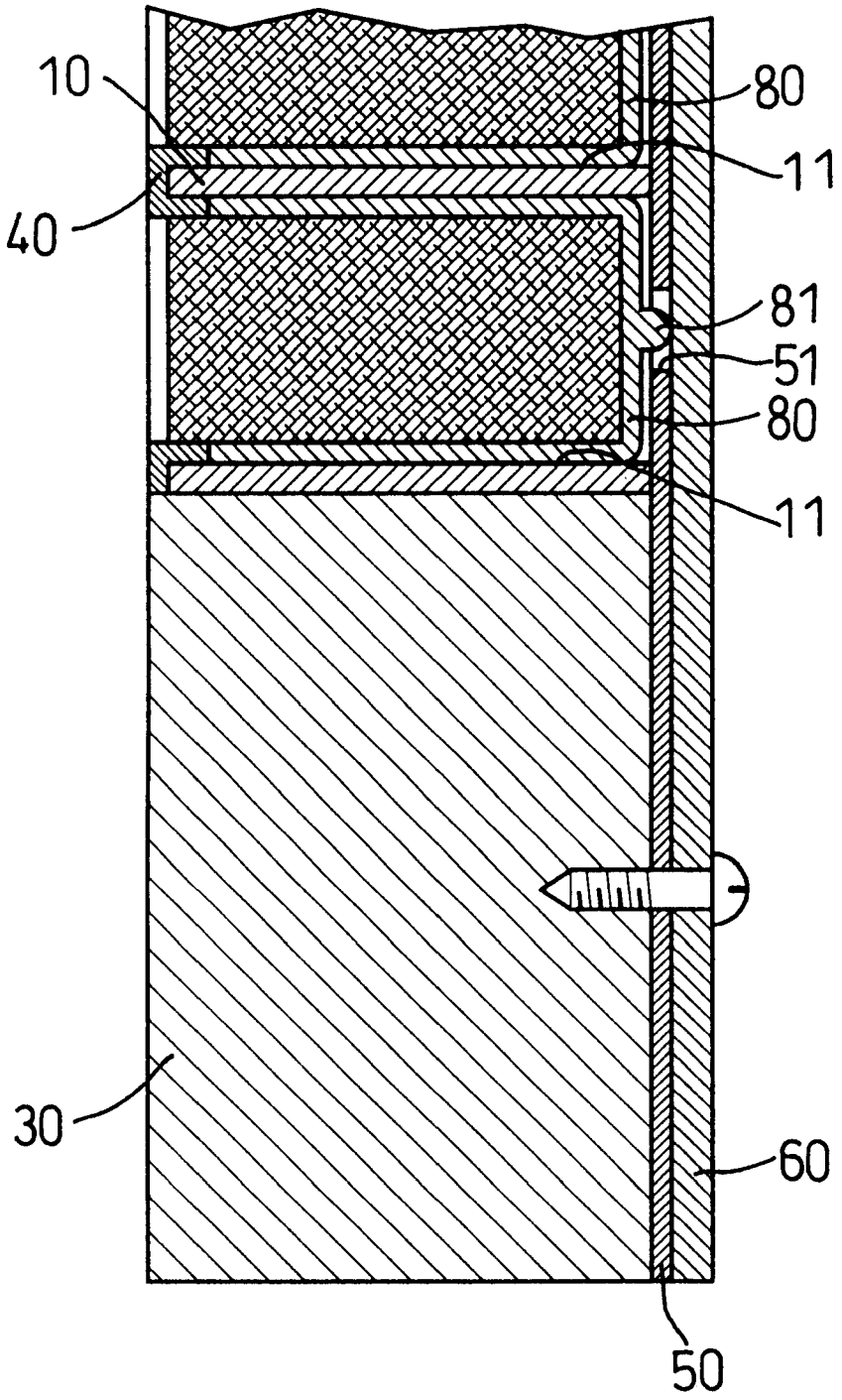
FIG.6 PRIOR ART
FIG. 6 is a partial cross sectional view of the conventional dartboard.

With reference to the FIG. 3, the plurality of springs (22) are respectively provided in the plurality of receiving spaces (11) and sandwiched between the rear board (50) and the target plates (20). The rear board (50) is defined with a plurality of holes (51) corresponding to the plurality of guide elements (21). Each spring (22) has a first end thereof fitted in the positioning hole defined in a center of the guide element (21) and connected with the guide element (21), and a second end thereof extended through a corresponding one of the holes (51) and lightly contacted with the electric circuit board (60), whereby the target plates (20) fitted in the receiving spaces (11) of the grid frame (10) are respectively movable in an axial direction within the receiving space (11).

When a dart (70) is thrown and stuck on the target plate (20), the target plate (20) depressed by the dart (70) axially moves within the receiving space (11) and towards the rear board (50). Then the springs (22) are compressed and urge against corresponding sensors of the electric circuit board (60), in such a way a signal of a dart's impact is sent out via the electric circuit board. Afterwards, the target plate (20) is automatically returned to its initial position by resilience of the springs (22).

The advantages of the present invention are that:

1. the target plates (20) hit by a dart (70) are depressed and then automatically returned to their initial static positions by resilience of the springs (22), which is very convenient for the people playing;
2. as the target plates (20) evenly pressed by resilience of springs (22) always return to their initial positions, the target plates (20) will never jam in the receiving spaces (11), and the second ends of the springs (22) will not stick on the electric board (60) when the target plates (20) are returned back to their initial position, therefore, the sensitivity of the sensors of the electric circuit board (60) and precision of the score calculation of the darts thrown are ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dartboard with auto-returning target plates, comprising a grid frame (10), a plurality of receiving spaces (11) defined in the grid frame (10) according to score sectors of the dartboard, a plurality of auto-returning target plates (20) respectively and movably received in the receiving spaces (11), an outer ring (30) enclosing the grid frame (10) therein, a grid (40) fixed on a front end of the grid frame (10), a rear board (50) mounted on rear ends of the grid frame (10) and the outer ring (30), and an electric circuit board (60) mounted on a rear end of the rear board (50), wherein it is characterized that:

each auto-returning target plate (20) has a plurality of guide elements (21) formed on a bottom surface thereof, and each guide element (21) corresponds to one of a plurality of springs (22) provided between the rear board (50) and target plates (20), the rear board (50) is defined with a plurality of holes (51) corresponding to the guide elements (21) of the target plates (20), each spring (22) has a first end thereof positioned by the corresponding guide elements (21), and a second end thereof extended through the corresponding holes (51) and lightly contacted with the electric circuit board;

whereby when a dart (70) is thrown and stuck on the target plate (20), the target plate (20) depressed by the dart (70) axially moves within the receiving space (11) and towards the rear board (50), then the springs (22) are compressed and urge against corresponding sensors of the electric circuit board (60), in such a way a signal of a dart's impact is sent out via the electric circuit board, and afterwards, the target plate (20) is automatically returned to its initial position by resilience of the springs (22).

2. The dartboard with auto-returning target plates as claimed in claim 1, wherein the guide element (21) is defined with a positioning hole in a center thereof, and the first end of the spring (22) is fitted in the positioning hole of the guide element (21).

* * * * *